US007942681B2

(12) United States Patent
Ni

(10) Patent No.: US 7,942,681 B2
(45) Date of Patent: May 17, 2011

(54) SAFETY RECEPTACLE WITH TAMPER RESISTANT SHUTTER

(75) Inventor: Lidong Ni, Zhejiang (CN)

(73) Assignee: Wenzhou MTLC Electric Appliances Co., Ltd., Yueqing (CN)

( * ) Notice: Subject to any disclaimer, the term of this patent is extended or adjusted under 35 U.S.C. 154(b) by 0 days.

(21) Appl. No.: 12/534,338

(22) Filed: Aug. 3, 2009

(65) Prior Publication Data

US 2010/0041259 A1 Feb. 18, 2010

Related U.S. Application Data

(63) Continuation-in-part of application No. 12/050,925, filed on Mar. 18, 2008, now Pat. No. 7,588,447.

(51) Int. Cl.
*H01R 13/44* (2006.01)

(52) U.S. Cl. ..... 439/137; 439/145

(58) Field of Classification Search ..... 439/135–145
See application file for complete search history.

(56) References Cited

U.S. PATENT DOCUMENTS 5,915,981 A * 6/1999 Mehta ..... 439/137
* cited by examiner

*Primary Examiner* — Ross N Gushi
(74) *Attorney, Agent, or Firm* — Ziegler IP Law Group, LLC

(57) ABSTRACT

The disclosed embodiments are directed to a protective shutter assembly that includes a registration member having longitudinal and lateral axes, first and second shutter members slidably mounted in the registration member, each shutter member including a ramp member and a receptacle blocking member, the ramp member being configured to lie in a path of a first receptacle opening and the receptacle blocking member being configured to lie in a path of a second receptacle opening, spring members connected between the registration member and respective ones of the first and second shutter members, the spring members being configured to bias the first and second shutter members so that the ramp members lie in a path of a respective receptacle opening, and wherein the first and second shutter members are independently movable such that when an object exerts a force on only one ramp member, a respective shutter member moves relative to the other shutter member such that the one ramp member is longitudinally displaced allowing the object to contact the receptacle blocking member of the other shutter member.

16 Claims, 20 Drawing Sheets

SAFETY RECEPTACLE WITH TAMPER RESISTANT SHUTTER

CROSS-REFERENCE TO RELATED APPLICATIONS

This application claims priority to, and is a continuation-in-part application of U.S. patent application Ser. No. 12/050,925, filed Mar. 18, 2008 now U.S. Pat. No. 7,588,447 the disclosure of which is incorporated herein by reference in its entirety.

BACKGROUND

1. Field

The aspects of the disclosed embodiments generally relate to electrical protection devices, and particularly to an electrical receptacle with a protective shutter mechanism.

2. Background

Electrical receptacles are widely used in daily life. Common electrical receptacles do not generally provide protective features to prevent foreign objects from being inserted into the openings of the receptacle. As such, it can be relatively easy to insert objects such as paper clips, screwdriver blades or iron wire into the receptacle contact openings. Unfortunately, this can often result in electric shock, burns, or electrocution.

In one approach, the electrical receptacles in the wiring devices are equipped with shuttered openings that prevent the insertion of foreign objects into the receptacle contact openings. The mechanism comprises a spring element that pushes the plastic chock block element, shuttering the openings. One drawback to this approach is the shutters will open at the forced insertion of foreign object into only one opening, exposing a person to a shock hazard. It would be advantageous to provide a shutter mechanism that will not open, and block exposure to the receptacle contacts, upon the insertion of an object into only one of the openings.

SUMMARY

In one aspect, the disclosed embodiments are directed to a protective shutter assembly. In one embodiment, the protective shutter assembly includes a registration member having longitudinal and lateral axes, first and second shutter members slidably mounted in the registration member, each shutter member including a ramp member and a receptacle blocking member, the ramp member being configured to lie in a path of a first receptacle opening and the receptacle blocking member being configured to lie in a path of a second receptacle opening, spring members connected between the registration member and respective ones of the first and second shutter members, the spring members being configured to bias the first and second shutter members so that the ramp members lie in a path of a respective receptacle opening, and wherein the first and second shutter members are independently movable such that when an object exerts a force on only one ramp member, a respective shutter member moves relative to the other shutter member such that the one ramp member is longitudinally displaced allowing the object to contact the receptacle blocking member of the other shutter member.

In another aspect, the disclosed embodiments are directed to an electrical receptacle. The electrical receptacle includes a housing for providing at least a hot and neutral receptacle to a power source, a cover attached to the housing having at least a first and second openings for allowing connection to a corresponding one of the hot or neutral receptacle, and a shutter device located within the housing, the shutter device being configured to block both the first and second openings when forces are unequally applied to the shutter device through the first and second openings.

DETAILED DESCRIPTION OF THE EXEMPLARY EMBODIMENT(S)

Figure 1:
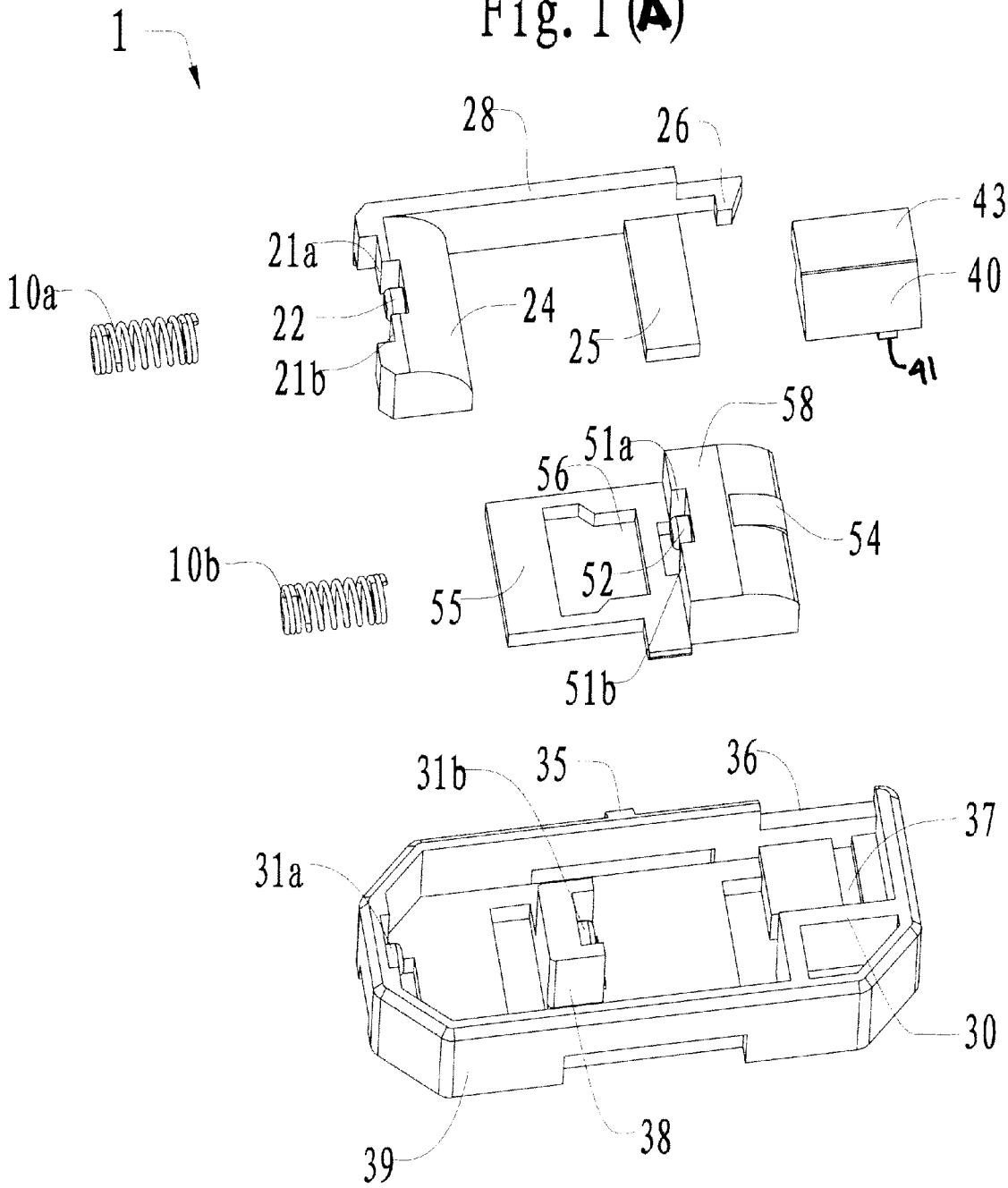
FIG. 1A is an elevation axonometric view of a protective shutter assembly incorporating aspects of the disclosed embodiments.
FIG. 1B is a rear axonometric view of a protective shutter assembly incorporating aspects of the disclosed embodiments.
Figure 1:
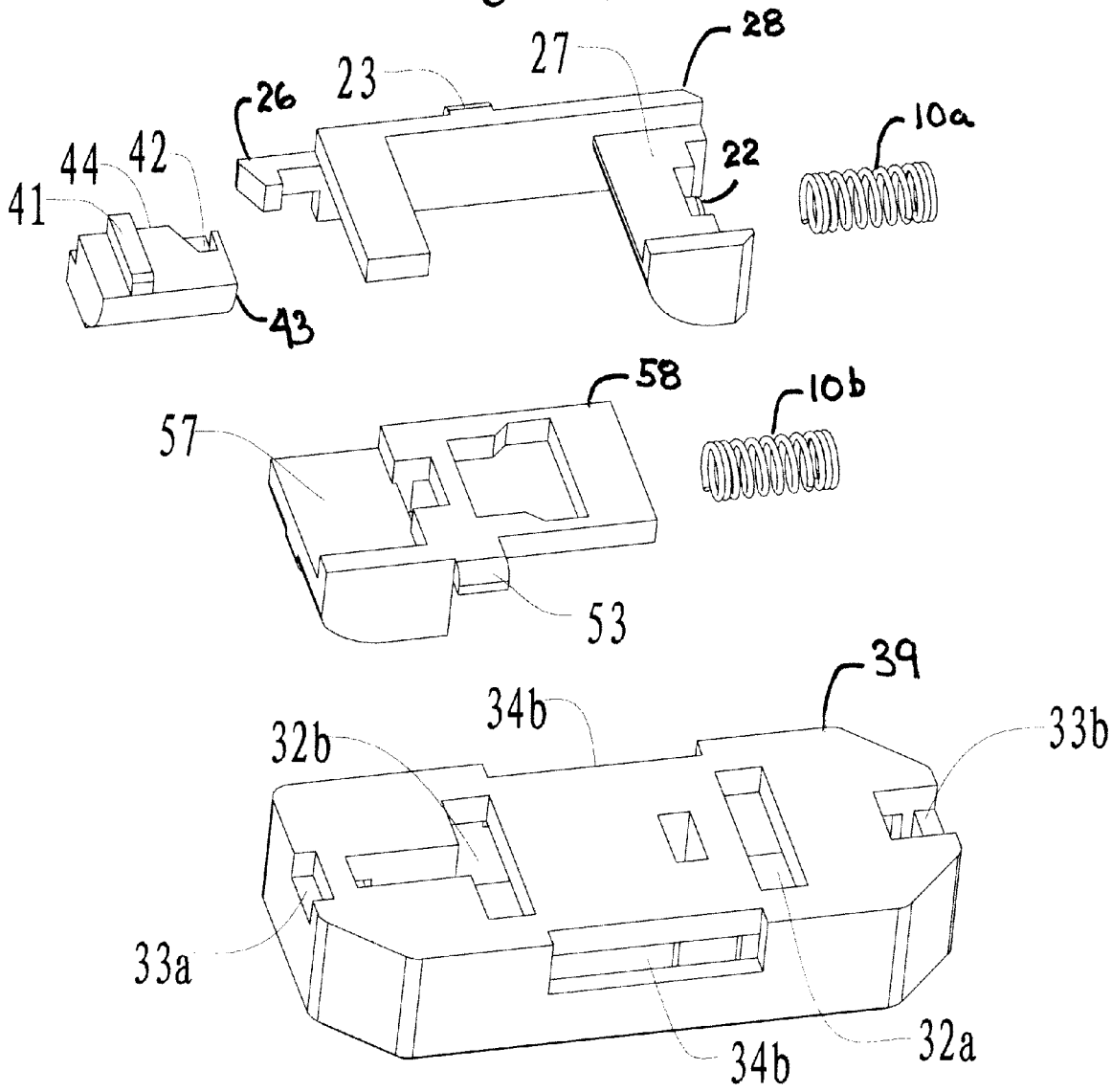

Referring to FIG. 1, a protective shutter assembly 1 for an electric receptacle is shown. Although the embodiments disclosed will be described with reference to the embodiments shown in the drawings, it should be understood that the embodiments disclosed can be embodied in many alternate forms. In addition, any suitable size, shape or type of elements or materials could be used.

The aspects of the disclosed embodiments are directed to a protective shutter assembly for an electrical receptacle, which can be embodied in a cover assembly for the electrical receptacle. In one embodiment, the protective shutter mechanism in the protective shutter assembly shutters the corresponding receptacle opening, and will open only when plug blades are inserted into both receptacle openings at substantially the same time. It is a feature of the disclosed embodiments that the protective shutter assembly will only operate to allow the complete insertion of plug blades into the receptacle openings when two plug blades are inserted into both openings in a balanced manner. This effectively prevents the insecurity that the shutters will open at the forced insertion of a foreign object into only one opening.

Figure 2:
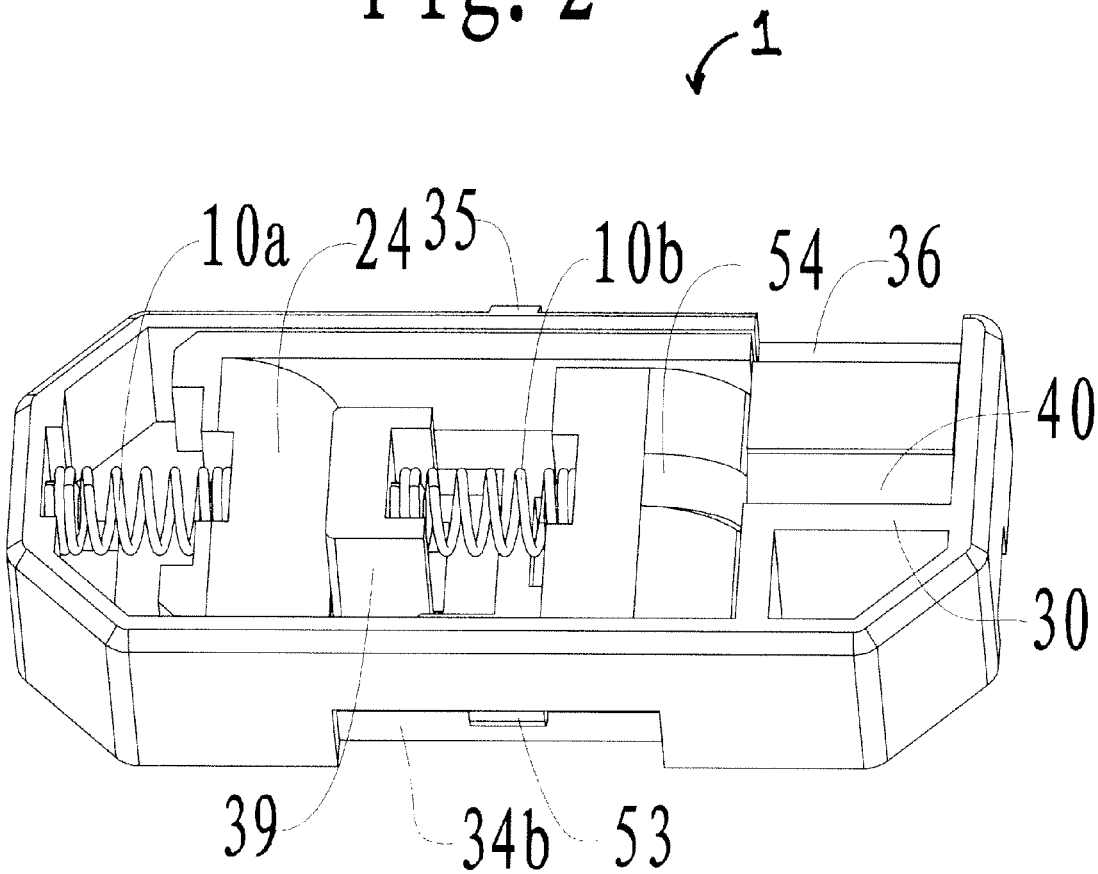
FIG. 2 is an axonometric view of a protective shutter assembly of the disclosed embodiments.

Referring to FIGS. 1A and 1B, in one embodiment, the protective shutter assembly 1 comprises a framed mechanism including three shutter members 28, 43 and 58, a registration member 39, and two resilient members 10*a*, 10*b*. Each resilient member 10*a*, 10*b*, which in one embodiment comprise springs, is disposed between respective shutter members 28, 58 and the registration member 39 as is shown in FIG. 2. While the resilient members are shown as coil springs in the figures, in other embodiments the resilient members may be any suitable resilient members including, but not limited to, leaf springs and spring washers. Movement of each shutter member 28, and 58, with respect to the registration member 39, will either compress or allow the extension of the corresponding resilient member 10*a*, 10*b*.

As shown in FIGS. 1A and 1B, the shutter member 28 includes a spring registration axis or protrusion 22, a shutter ramp 24, and spring registration blocks 21*a* and 21*b*. In other embodiments, the spring 10*a* may be registered against the shutter member 28 in any suitable manner, such as for example through corresponding spring receiving receptacles or recesses. The shutter member 28 also includes a longitudinal retaining member 26, guide path 27, shutter blocking member 25 and horizontal retaining lip or axis 23. The longitudinal retaining pocket 25 is configured to move in longitudinal retaining orbit 26 and prevent shutter member 29*a* and shutter member 29*b* moving from side to side.

The registration member 39 includes a registration orbit 30, spring registration axis 31*a* and 31*b* and retaining lip or orbit 35. In one embodiment, there are two polarity receptacle openings 32*a* and 32*b* as shown in FIG. 1B. The installation chamfers 33*a* and 33*b*, shutter orbits 34*a* and 34*b*, abdicator notch 36 and guide path 37 are configured to allow the shutter member 43 to slide along an approximate middle of the guide path 37. The guide block 38 directs the shutter member 58.

Figure 5:
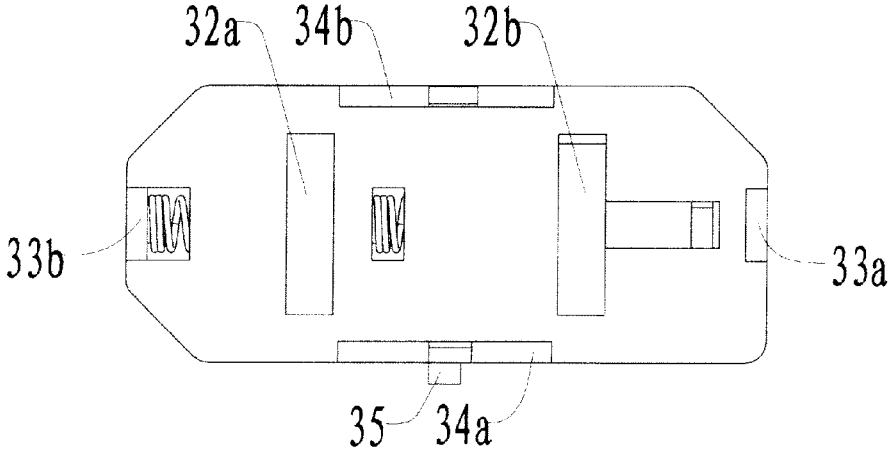
FIG. 5 is a rear view of the protective shutter assembly shown in FIG. 2.

In the embodiment shown in FIGS. 1A, 1B and 5, the base of the registration member 39 includes two polarity receptacle openings 32*a*, 32*b* and a registration orbit or slot 30. The polarity receptacle openings 32*a* and 32*b* are generally configured to receive corresponding electrical blades or contacts. The size and configuration of the openings 32*a* and 32*b* can be configured to any suitable number or openings having any suitable size and shape.

As illustrated in FIG. 5, the registration member 39 may also include recesses 34*a*, 34*b* for slidingly engaging the horizontal retaining axis 53 of shutter member 58.

The shutter member 43 shown in FIGS. 1A and 1B includes the shutter ramp 40, guide orbit 41, chamfer 42 and shutter wall 44.

The shutter member 58 includes the spring registration axis 52, shutter ramp 54 and spring registration blocks 51*a* and 51*b*. Guide paths 56 and 57, horizontal retaining axis 53 and shutter block 55 are on embodied in the base of the shutter member 58.

Figure 3:
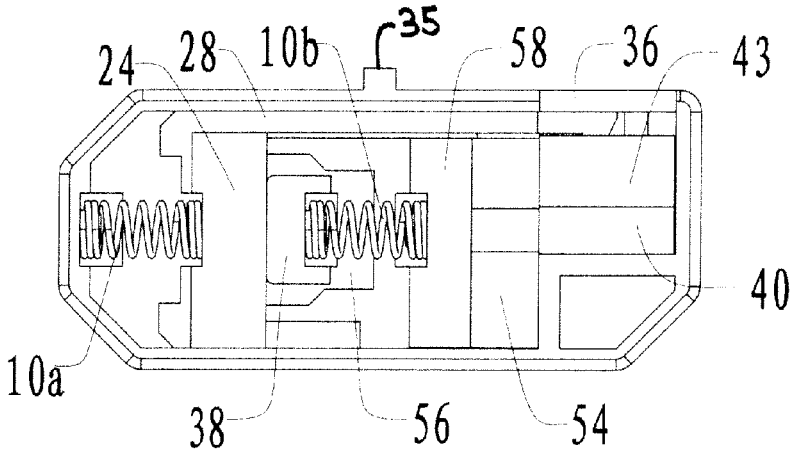
FIG. 3 is an elevational view of the protective shutter assembly shown in FIG. 2.
Figure 4:
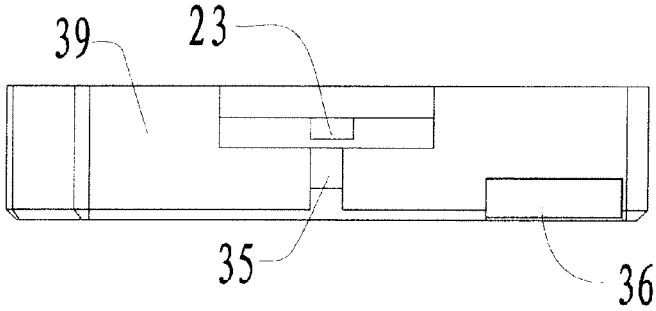
FIG. 4 is aside view of the protective shutter assembly shown in FIG. 2.

FIG. 2 illustrates one example of a protective shutter assembly 1 with the shutter members 28, 43, 58 and resilient members 10*a*, 10*b* assembled within the registration member 39. FIG. 3 is a bottom view of the assembly 1 of FIG. 2, while FIG. 4 is aside view of the assembly 1 shown in FIG. 2. FIG. 5 is a top plan view of the assembly 1 shown in FIG. 2.

Figure 6:
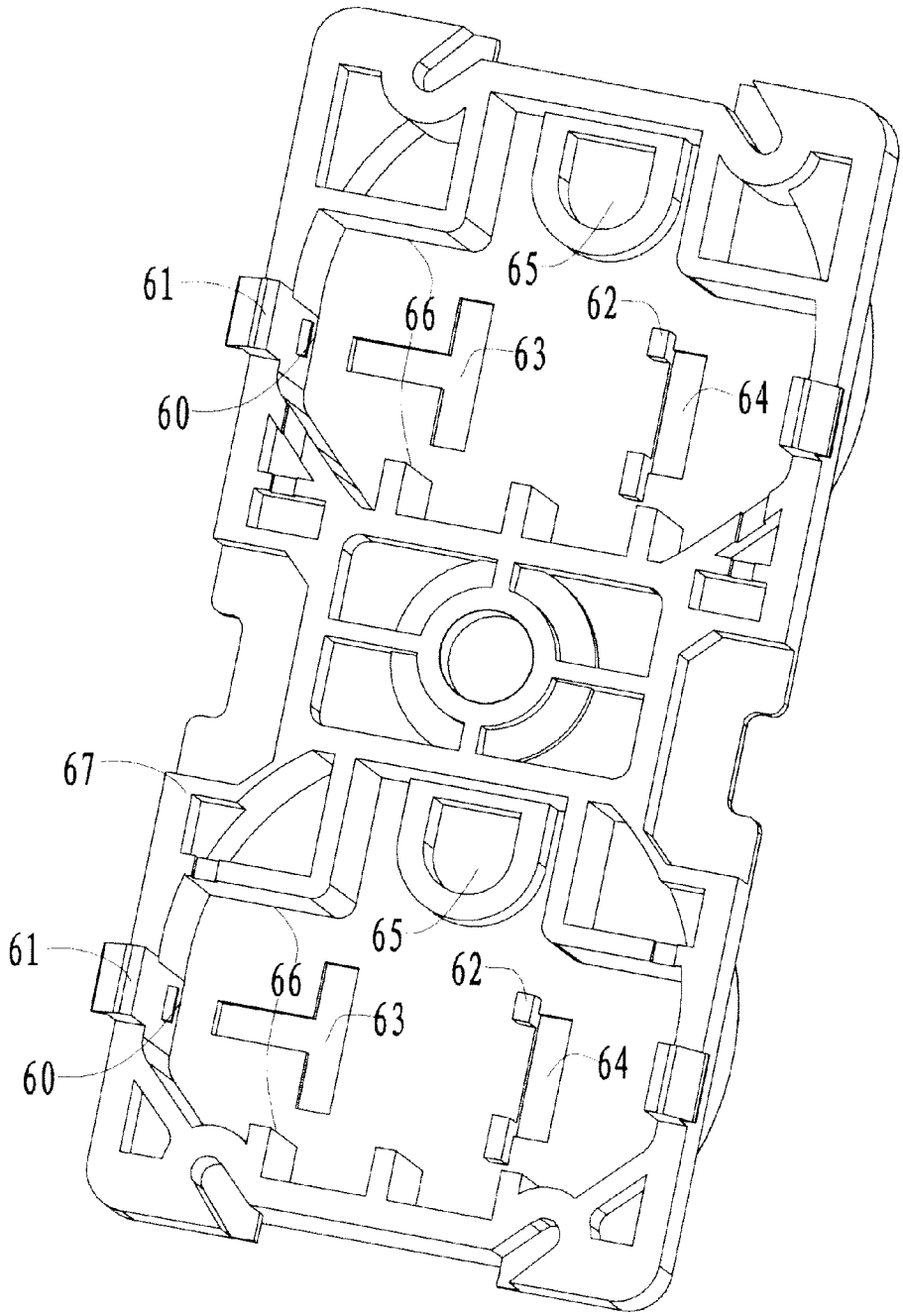
FIG. 6 is an axonometric view of an internal portion of an exemplary cover assembly for the protective shutter assembly of the disclosed embodiments.
Figure 7:
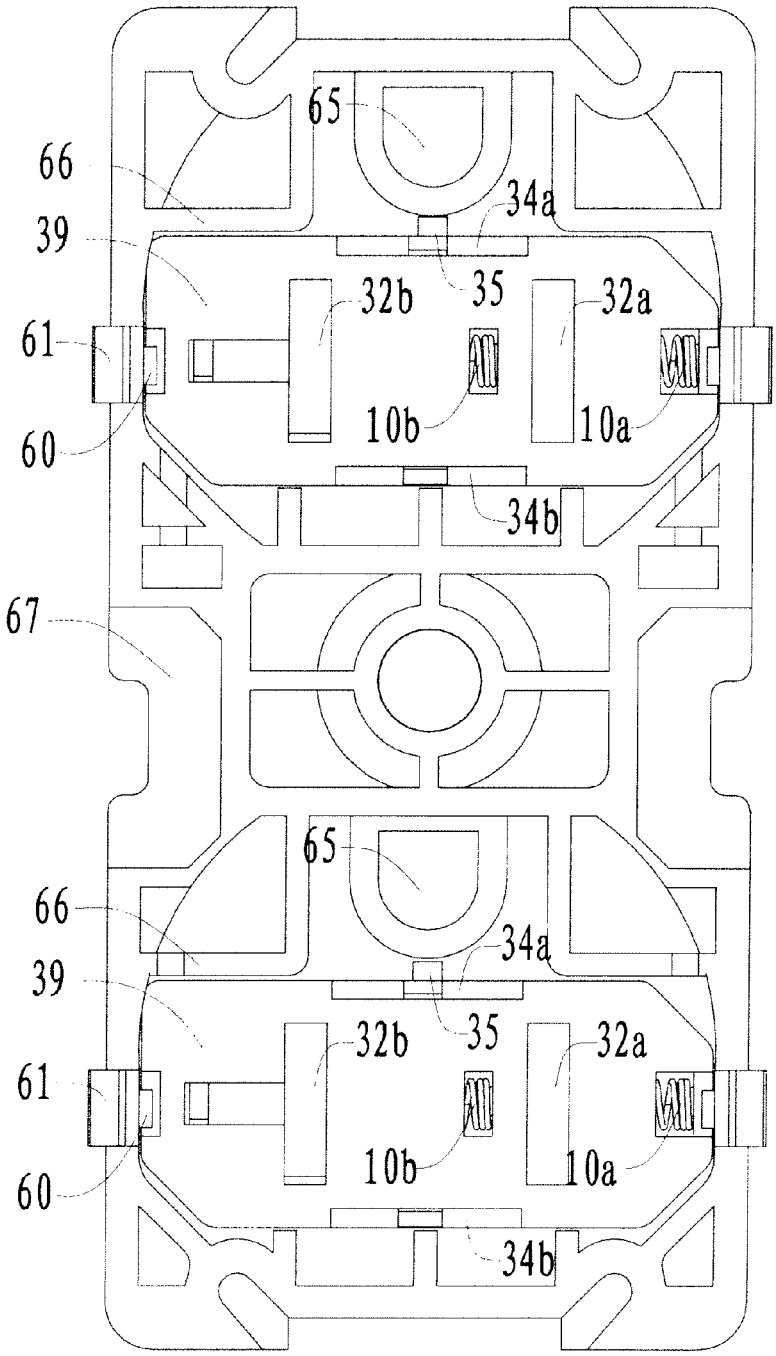
FIG. 7 is a plan view of an internal portion of the cover assembly shown in FIG. 6 including the protective shutter assembly of FIG. 2 embodied therein.
Figure 14:
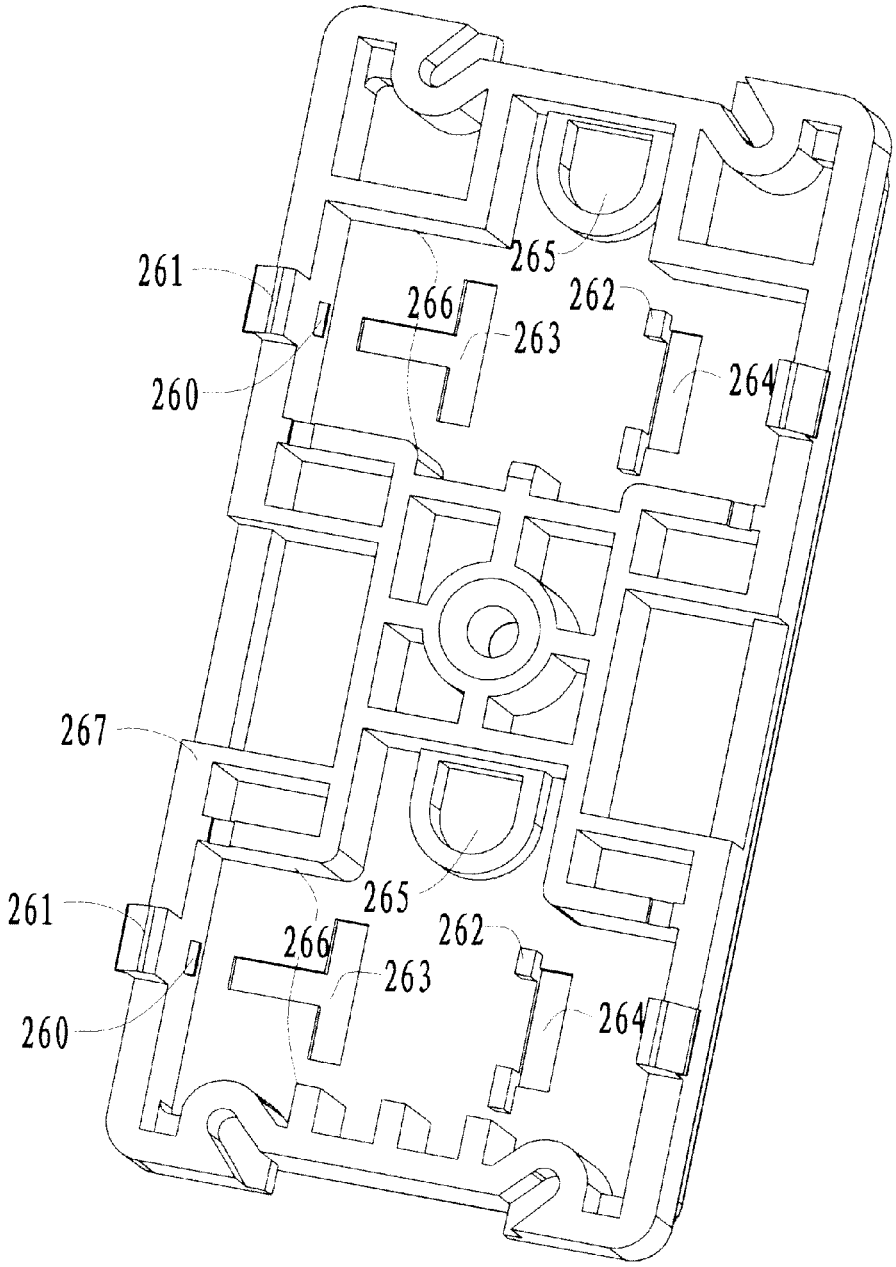
FIG. 14 is a plan view of an internal portion of the cover assembly illustrated in FIG. 13.
Figure 15:
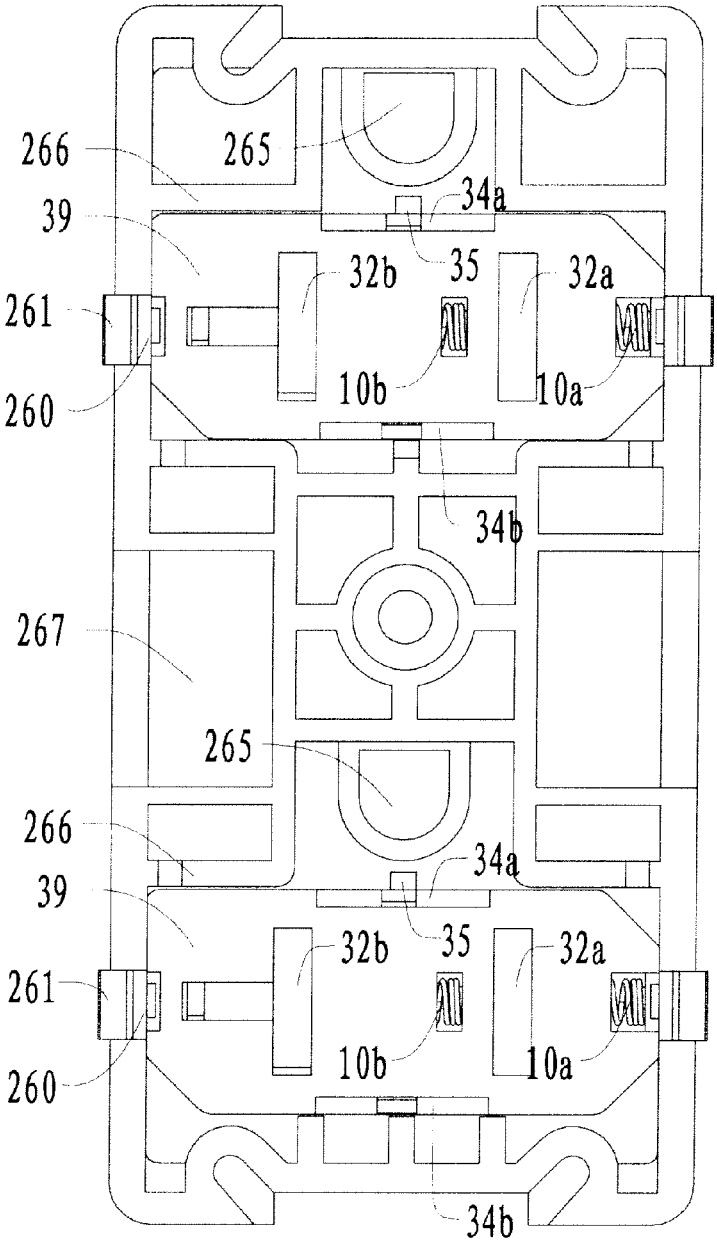
FIG. 15 is a plan view of an internal portion of the cover assembly illustrated in FIG. 13 with a pair of protective shutter assemblies incorporating aspects of the disclosed embodiments embodied therein.
Figure 16:
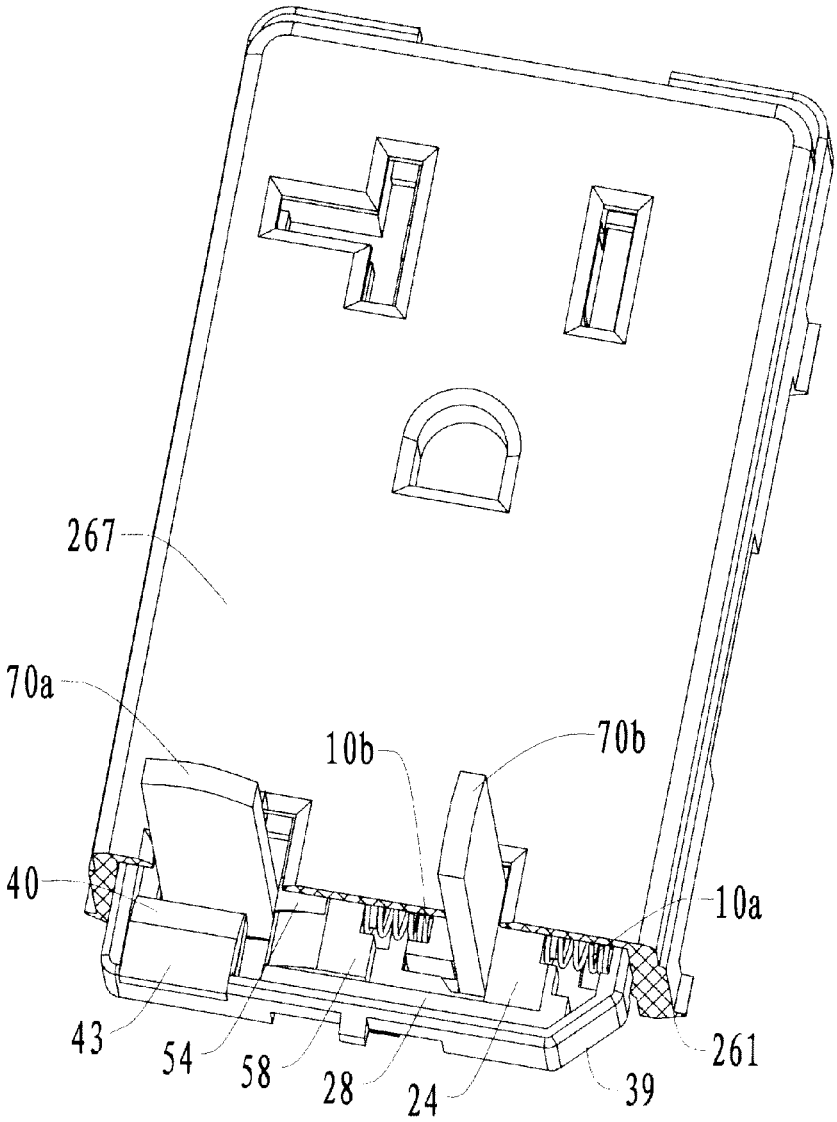
FIG. 16 is a plan view of the external portion of an exemplary cover assembly with a protective shutter assembly as shown in FIG. 2 embodied therein having a pair of plug blades inserted into each of the receptacle openings.

FIG. 6 and 14 illustrate plan views of an exemplary cover assemblies that can be used with the protective shutter assembly 1 shown in FIG. 2. It is noted that the cover assemblies may have any suitable configuration and should not be limited to those shown and described herein. As shown in FIGS. 6 and 14, embodied in the upper cover 67, 267 are a hot receptacle opening 64, 264, a neutral receptacle opening 63, 263 and a grounding receptacle opening 65, 265. The cover 67, 267 can also include retainers 62, 262 and retaining walls 66, 266 to retain the protective shutter assembly 1 of FIG. 2 in the cover assembly 67, 267. The registration member 60 fixes or secures the protective shutter assembly 1 in the cover 67. The installation latch 61 fixes the upper cover 67 to the base of the receptacle main body. FIGS. 7 and 15 illustrate examples of the protective shutter assembly 1 retained in the cover 67, 267 of FIGS. 6 and 14, respectively.

In one embodiment, the installation latch 61, 261 fixes the protective shutter assembly 1 of FIG. 2 in the cover 67, 267. The installation latch 61, 261 is used to fix the cover 67, 267 to the base of the main body of the receptacle. In other embodiments the cover 67, 267 may be coupled, either removably or fixedly, to the main body in any suitable manner including, but not limited to, adhesives, ultrasonic welding or mechanical fasteners.

Figure 8:
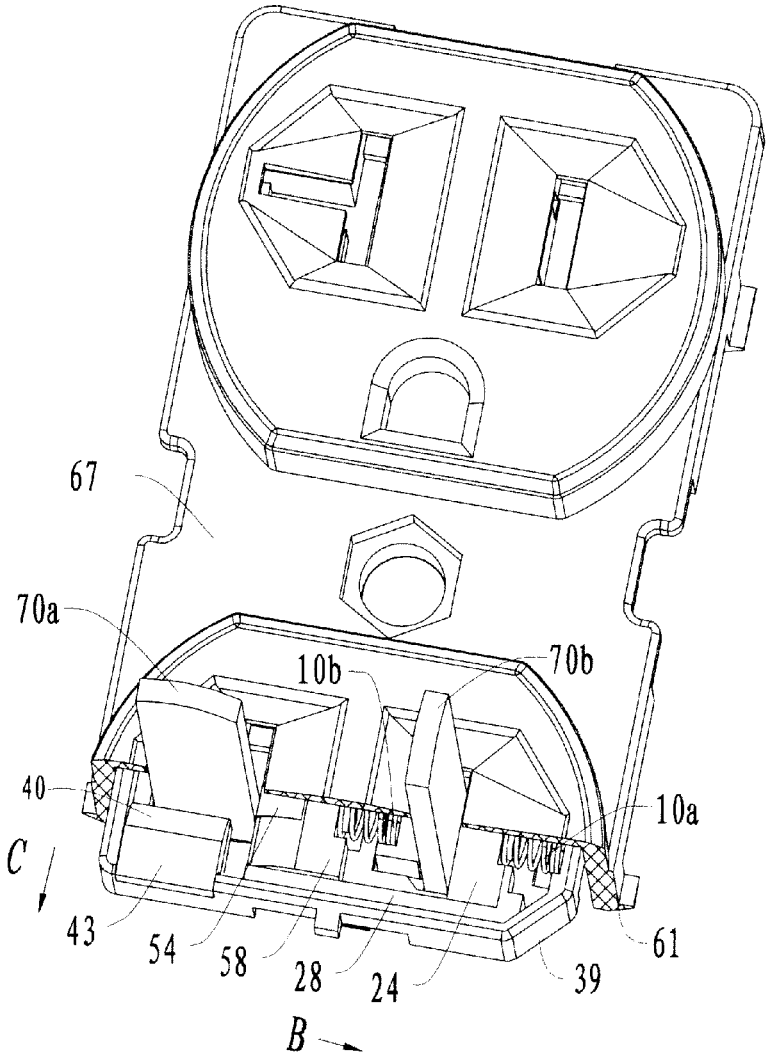
FIG. 8 is a plan view of the external portion of the cover assembly shown in FIG. 6 with the protective shutter assembly of FIG. 2 embodied therein with plug blades inserted into each of the openings.
Figure 9:
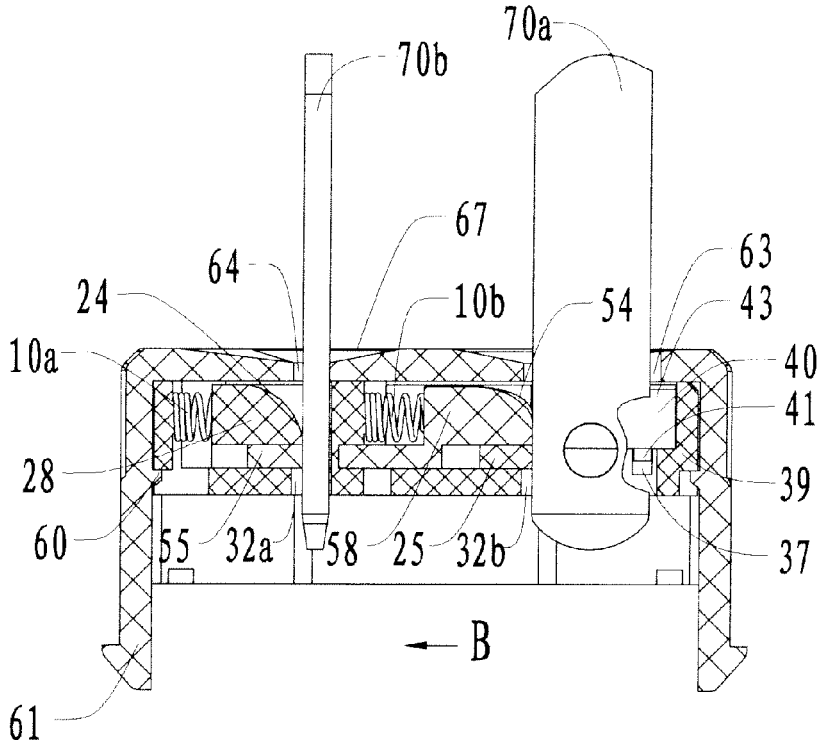
FIG. 9 is a cross-sectional view of the plan view of FIG. 8, illustrating plug blades inserted into each of the receptacle openings.

FIG. 8 is a plan view of the external portion of the cover assembly shown in FIG. 6 with the protective shutter assembly of FIG. 2 embodied therein. As shown in FIGS. 8 and 9, the receptacle assembly 800 includes complementary pairs of receptacle openings 32*a*, 32*b* for exemplary purposes only. In alternate embodiments, a receptacle assembly 800 can include any suitable number of receptacle openings.

FIG. 9 is a cross-sectional view of one example of an electrical receptacle device, such as assembly 800 shown in FIG. 8, including a protective shutter assembly with plug blades 70*a*, 70*b* inserted into each of the receptacle openings 32*a*, 32*b*, respectively. When a pair of plug blades 70*a*, 70*b* is inserted into each respective receptacle opening, 32*a*, 32*b* substantially simultaneously or in a balanced manner, the protective shutter assembly 1 is configured to allow the blades 70*a*, 70*b* to pass through the receptacle openings, 32*a*, 32*b* as will be described in greater detail below. This allows the blades 70*a*, 70*b* to establish an electrical connection with a supply source or receptacles (not shown).

However, the aspects of the disclosed embodiments will effectively prevent the insertion of only one plug blade, or foreign object, into only one of the openings. When such an attempt is made, the protective shutter assembly 1 of FIG. 2 will block both receptacle openings 32*a*, 32*b*.

Figure 12:
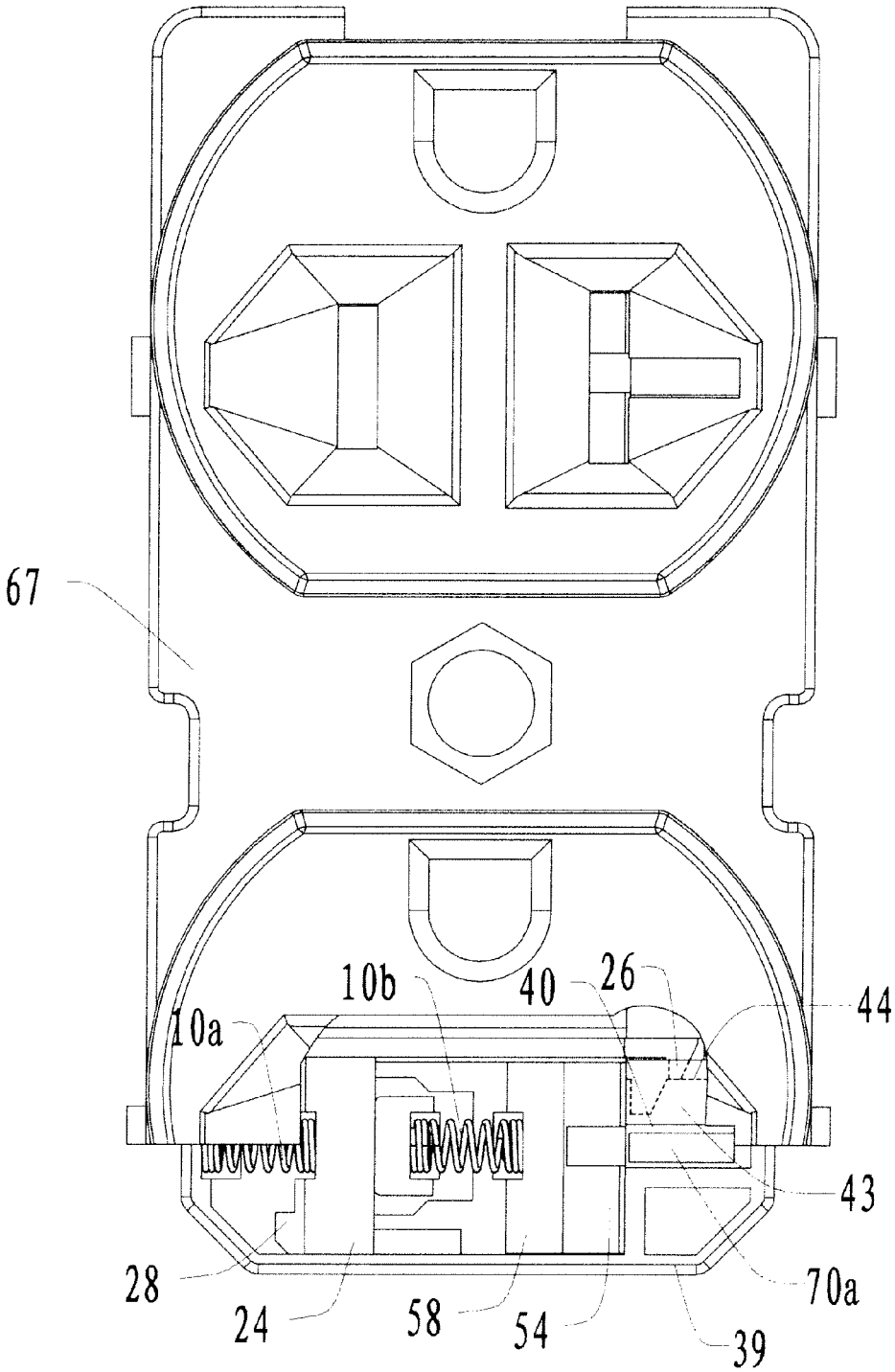
FIG. 12 is an elevational view of the electrical receptacle device with one plug blade inserted into one receptacle opening.

Referring also to FIG. 12, before the plug element 70*a* is inserted into one of the receptacle openings 32*a*, 32*b* the shutter members 28, 43, 58 are in an initial or neutral, such as that shown in FIG. 12. In this initial position, the blocking members 25, 55 of shutter members 28 and 58, block each of the respective receptacle openings 32*a* and 32*b*. In one embodiment, in the initial position the shutter members 28, 43 are substantially symmetrically located about centerline of the registration member 39. The resilient members 10*a*, 10*b* may be configured such that the forces exerted on their respective shutter members 28, 43 are substantially equal so that the resultant force exerted by the resilient members 10*a*, 10*b* place the shutter members as shown in FIG. 12 when the springs are at equilibrium.

When the receptacle is not in use, and there is no plug blade 70*a* or 70*b* inserted in the respective openings 64 and 63, the three shutters 28, 43, 58 and ramps 24, 40 and 54 are configured to block the polarity receptacle openings 32 and 32*b*, corresponding to the registration member 39. When the receptacle is in use, as shown in FIGS. 8 and 9, the plug blades 70*a* and 70*b* are inserted into the neutral receptacle opening 63 and the hot receptacle opening 64, respectively, through the upper cover 67. The plug blades 70*a* and 70*b* will first arrive at each of the shutter ramps 24, 40 and 54 of shutter member 28, 43 and 58. A continuing urging or pressing of the blades 70*a* and 70*b* will cause each of the shutter ramps 24 and 54 to move in the direction of B. The shutter ramp 40 is configured to move in the direction of C until the shutter ramps 24, 40 and 54 are displaced by the plug blades 70*a* and 70*b*, and the polarity receptacle openings 32*a* and 32*b* on the registration assembly 39 are occupied. The neutral receptacle opening 63 and hot receptacle opening 64 in the cover 67 align themselves to the polarity receptacle openings 32*a* and 32*b* in the registration member assembly 39.

As the plug blades 70*a* and 70*b* are inserted into the receptacle main body, the springs 10*a* and 10*b* are stressed. When the plug blades 70*a* and 70*b* are pulled out of the receptacle main body, the shutters 28, 43 and 58 return to their initial positions. Springs 10*a* and 10*b* return to their previous shape. In this state, the polarity receptacle openings 32*a* and 32*b* are blocked.

Figure 10:
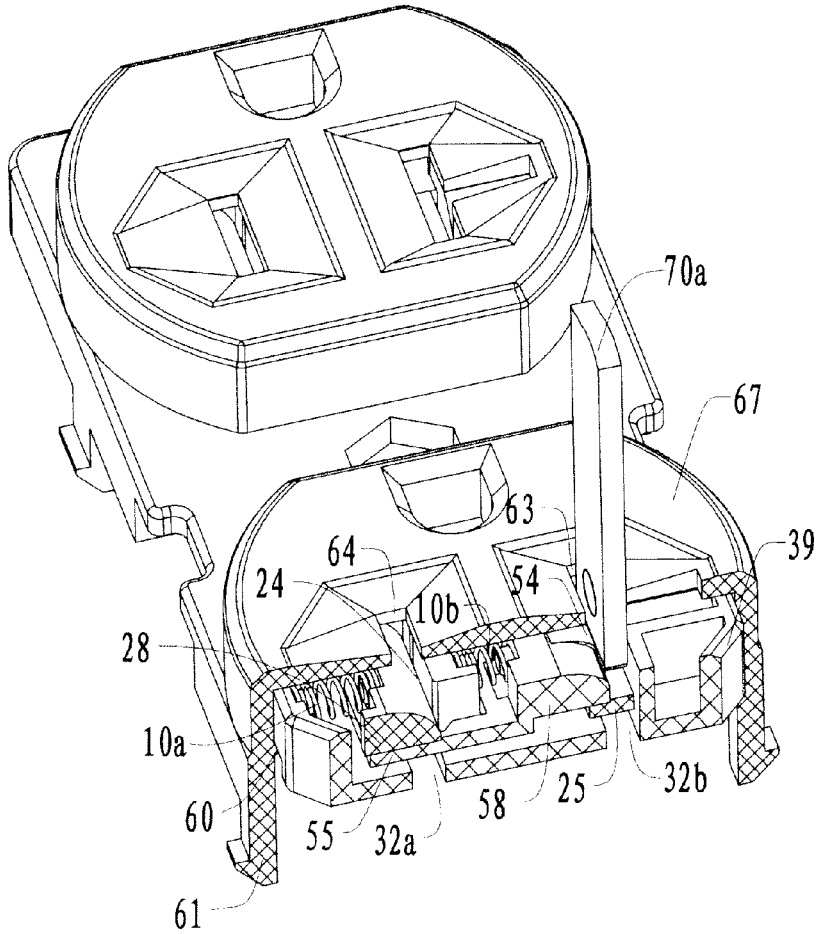
FIG. 10 is a axonometric view of the electrical receptacle device including the protective shutter assembly shown in FIG. 9 with plug blades inserted into one of the receptacle openings.
Figure 11:
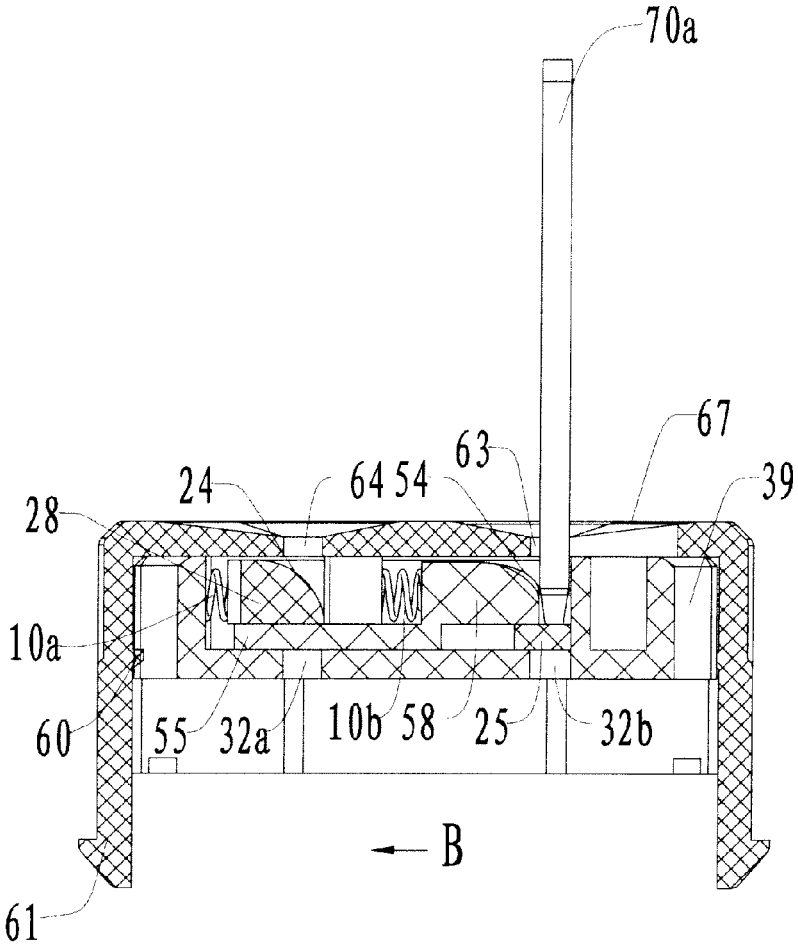
FIG. 11 is a cross-sectional view of the device shown in FIG. 10.

Referring to FIGS. 10 and 11, an example where an attempt is made to insert a single plug blade 70*a* into receptacle 63 of the protective shutter assembly 1 is shown. When only one plug blade 70*a* is inserted into the neutral receptacle opening 63 through the upper cover 67, as shown in FIGS. 10 and 11, the plug blade 70*a* arrives at the shutter ramp 54 of shutter member 58. If the plug blade 70*a* is continued to be pushed, the shutter ramp 54 will move in the direction B, as shown in FIG. 11. At the same time, the spring 10*b* will contract or be compressed, but the shutter 28 will hold its position since without any force applied to it, the shutter block 25 will continue to block the polarity opening 32*b*.

Similarly, when only one plug blade 70*b* is inserted into the hot receptacle opening 64 through the upper cover 67, the blade 70*b* will contact the ramp 24 of registration member 28. The shutter ramp 54 will block the (neutral) polarity receptacle opening 63.

Figure 13:
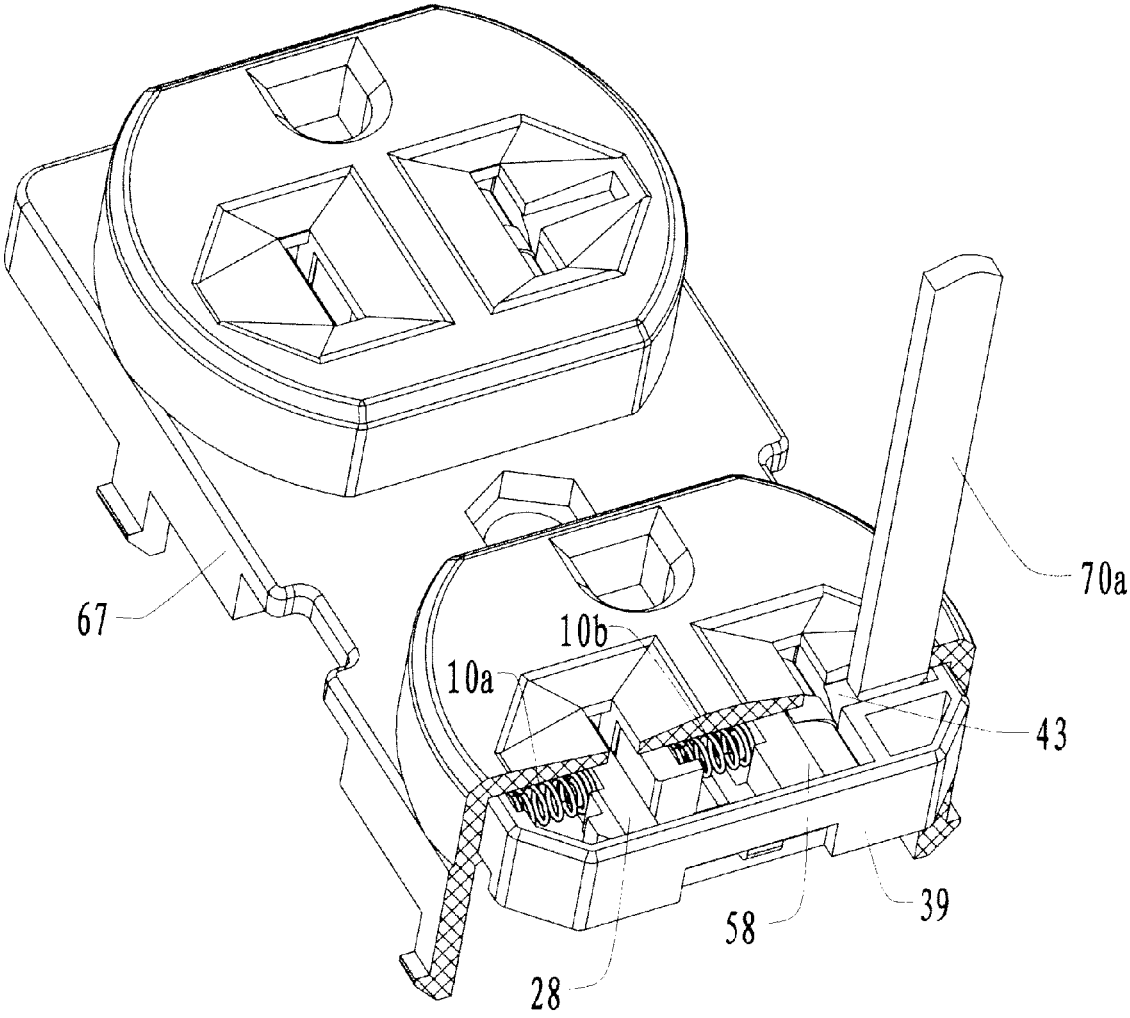
FIG. 13 is a section plan view of an electrical receptacle device with one plug blade inserted into one receptacle opening.

If the plug blade 70*a* is inserted into the polarity receptacle opening 32*b* and neutral receptacle opening 63 as shows in FIGS.12 and 13, the plug blade 70*a* first arrives at the shutter ramp 40 of shutter member 43. The retainer 26 of shutter 28 will block the shutter wall 44 of shutter 43. Thus the shutter wall 44 does not move and the shutter 43 blocks the polarity receptacle opening 32*b* so the plug blade 70*a* cannot be inserted into the receptacle main body (the electrical connections).

This effectively avoids or prevents the danger of foreign objects being inserted in a receptacle contact opening and making an electrical connection, which can cause electric shock hazard. Although this example has been described with the use of plug element 70*a*, it will be understood that the blocking mechanism of the protective shutter assembly of the disclosed embodiments will react similarly to insertion of any suitable object into only one of the two openings 32*a*, 32*b*. The configuration of the shutter members 28, 43 and 58 to substantially contact each other in the manner described above prevents the sequential insertion of objects into the openings 32*a*, 32*b*. It is only when two suitable elements, such as elements 70*a* and 70*b*, are substantially simultaneously, or in a balanced manner inserted into the openings 32*a*, 32*b*, that the respective shutter members 28, 43, 58 will move sufficiently to allow the elements 70*a*, 70*b* to pass by blocking members 25, 55 and into the corresponding polarity receptacle opening 32*a*, 32*b*. It is noted that the width W of the ramp members 24,40, and 54*a* re configured to allow a predetermined amount of travel in opposite directions so that ramp members 24, 40 and 54 and both blocking members 25, 55 are clear of the openings 32*a*, 32*b*, 63, 64 when objects are substantially simultaneously and/or in a balance manner inserted into both opening 63, 64 as shown in, for example FIG. 9.

Figure 17:
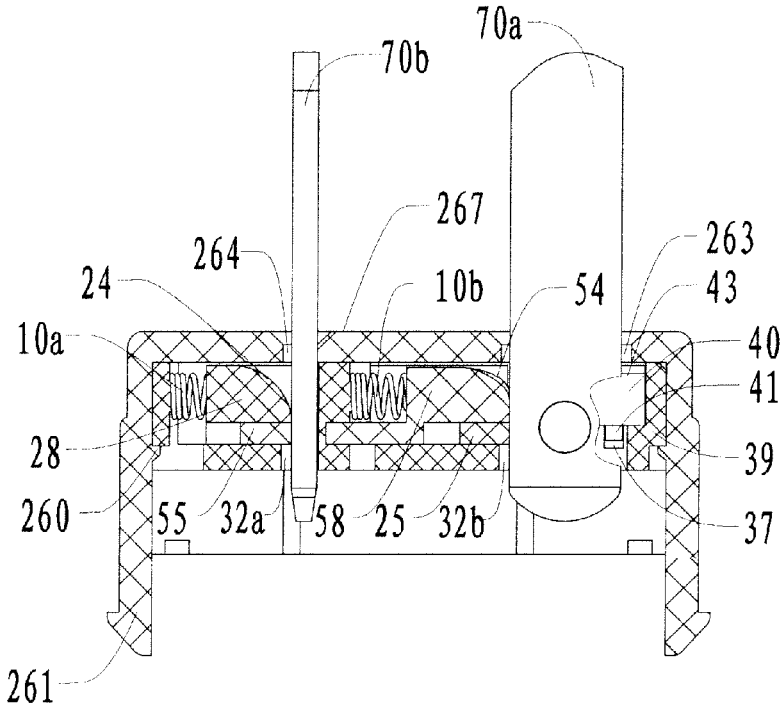
FIG. 17 is a cross-sectional view of the device illustrated in FIG. 16, with plug blades inserted into each of the receptacle openings.
Figure 18:
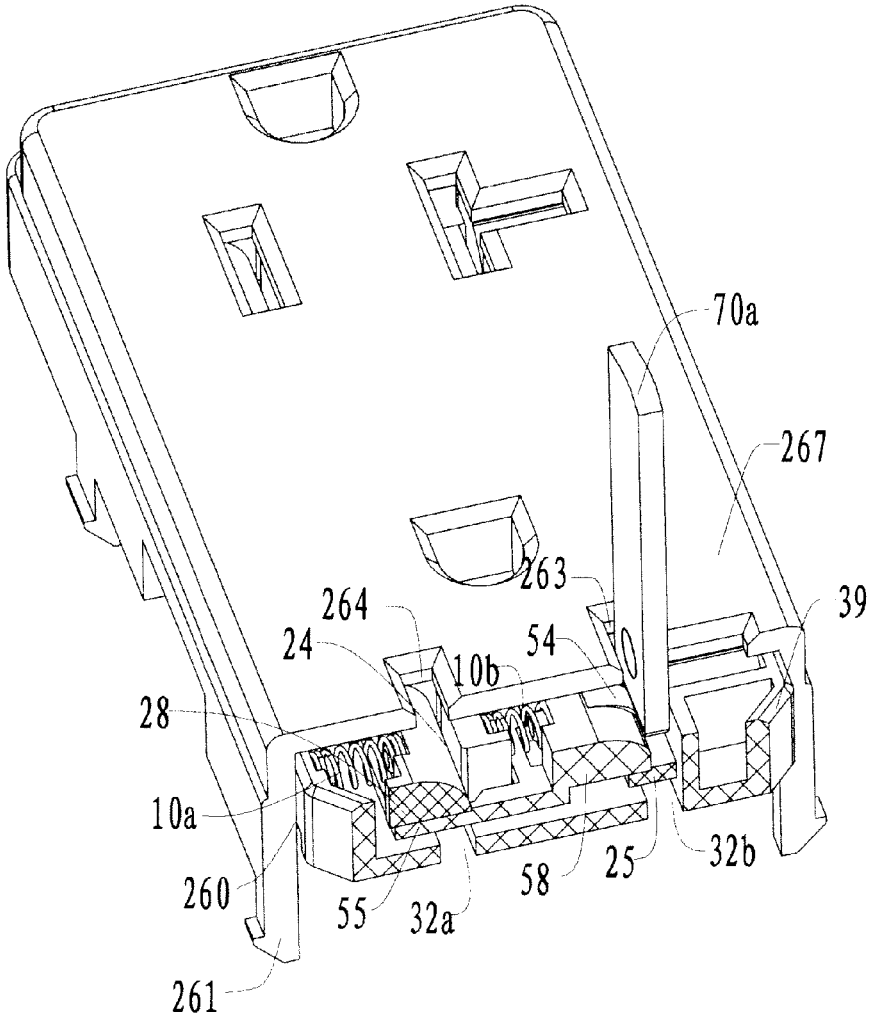
FIG. 18 is an axonometric view of the device illustrated in FIG. 16 with only one plug blade inserted in only one receptacle opening.
Figure 19:
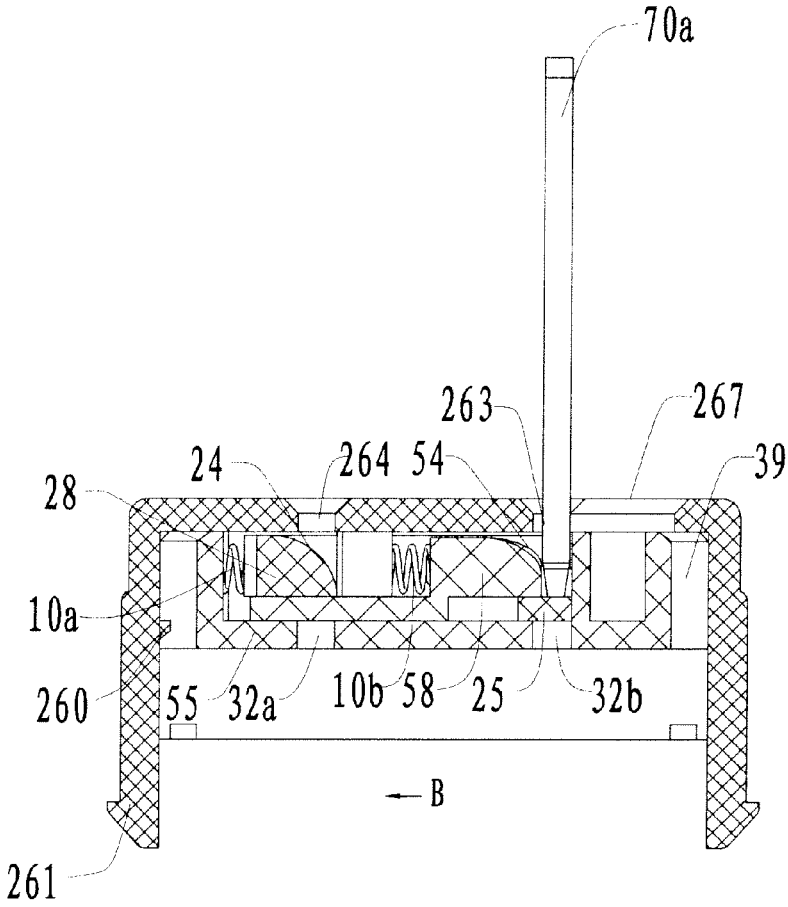
FIG. 19 is a cross-sectional view of the device of FIG. 18 with only one plug blade inserted into only one receptacle opening.
Figure 20:
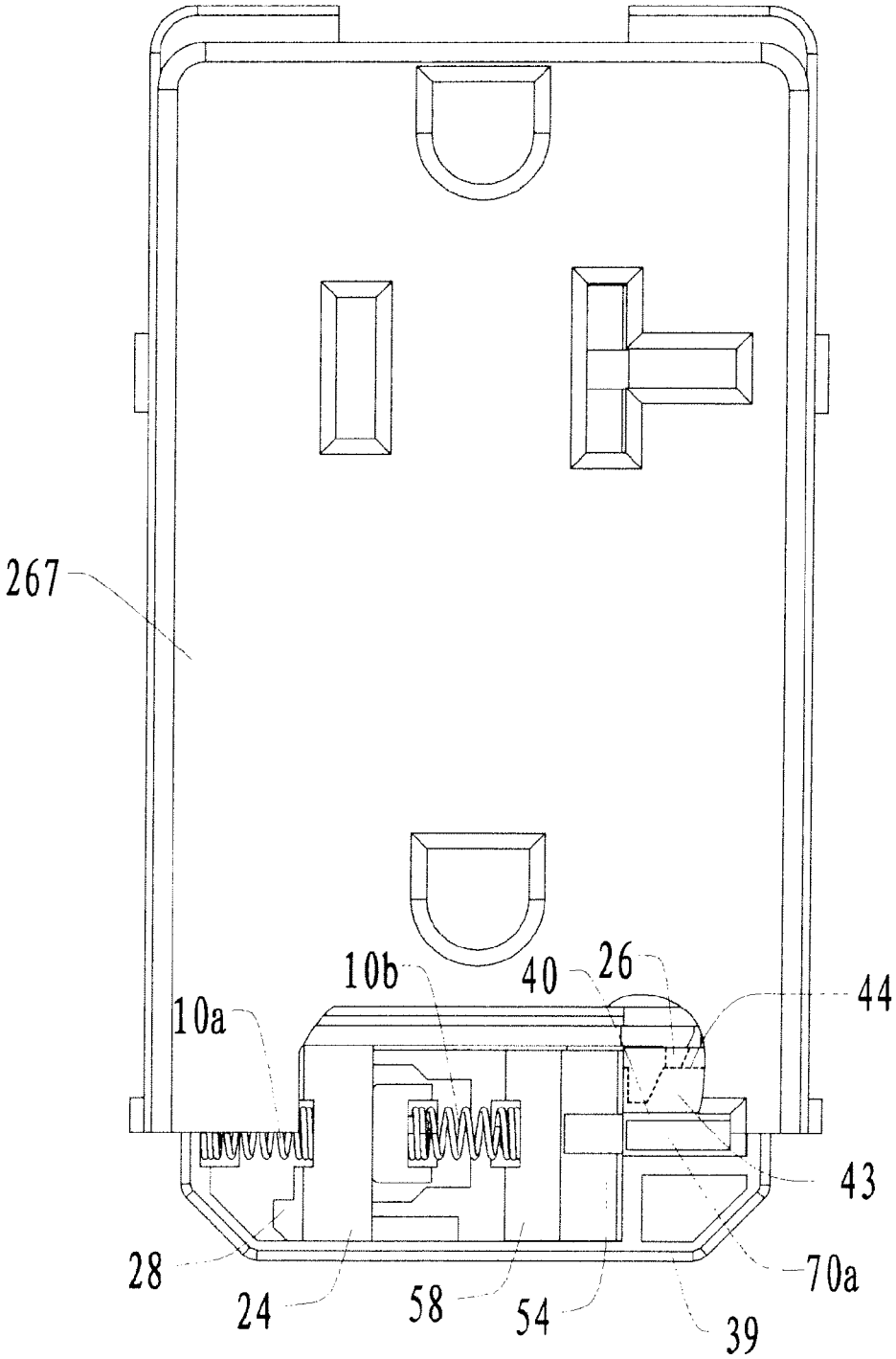
FIG. 20 is an axonometric view of the external portion of an exemplary cover assembly with a protective shutter assembly as shown in FIG. 2 embodied therein and FIG. 21 shows one plug blade inserted into one opening of the device shown in FIG. 20.
Figure 21:
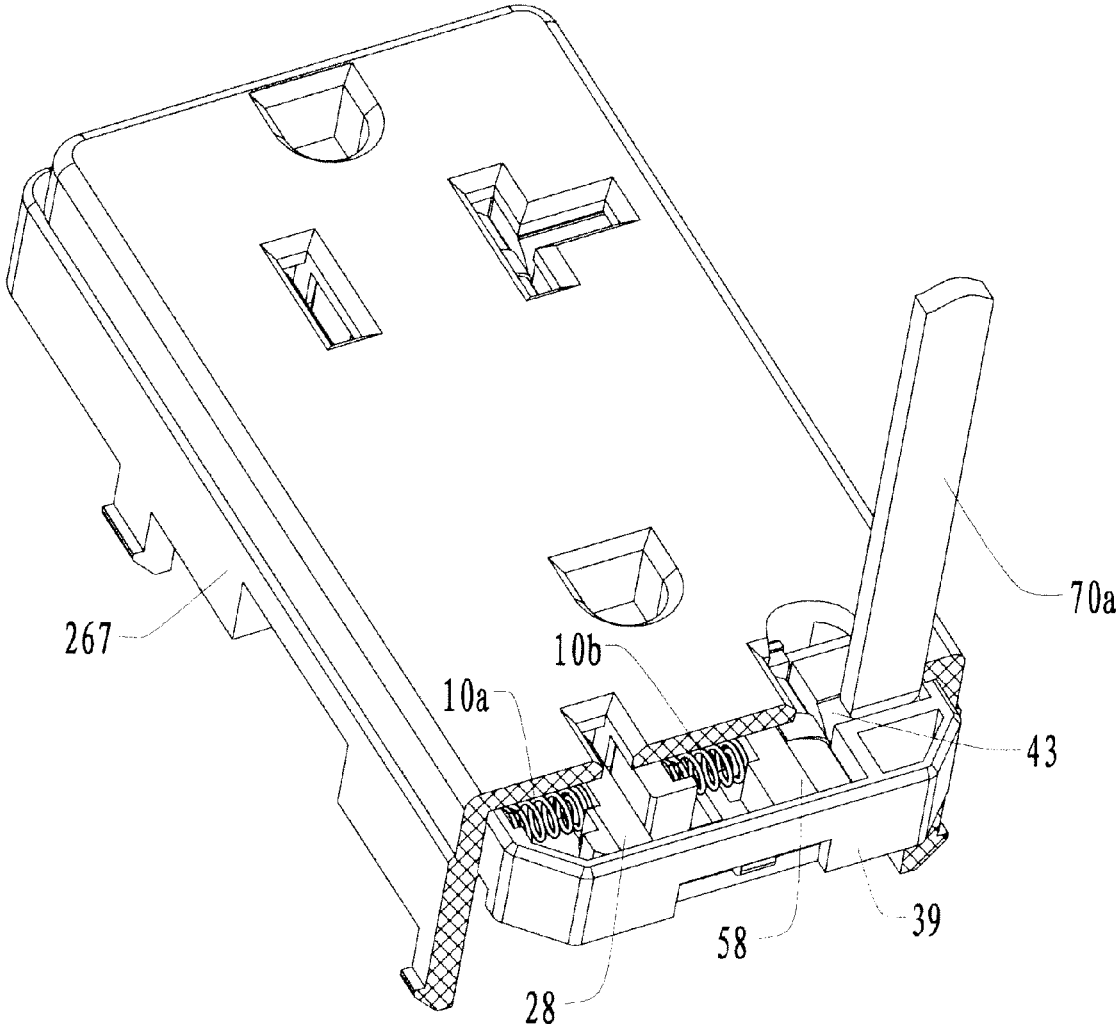

Referring to FIGS. 9 and 17, when the receptacle is in use, plug blades 70*a* and 70*b* are inserted into the neutral receptacle opening 63, 263 and the hot receptacle opening 64, 264 respectively through the cover 67, 267. The neutral receptacle opening 63, 263 and hot receptacle opening 64, 264 of the cover 67, 267 substantially align to the respective polarity receptacle openings 32*a*, 32*b* of the registration assembly 39. FIGS. 9 and 17 illustrate an example where two plug elements 70*a*, 70*b* have been substantially simultaneously inserted into corresponding receptacle openings 63, 64. As shown in FIG. 9, as plug blades 70*a*, 70*b* are being substantially simultaneously inserted into the respective receptacle openings 64 and 63, each plug blade 70*a*, 70*b* first arrives at a respective shutter ramp 24, 40. Continued insertion of the plug blades 70*a*, 70*b* will cause each shutter ramp member 24, 40 to move or slide in direction B within the registration member 39. This moves the shutter members 28 and 43 far enough to allow plug blades 70*a*, 70*b* to extend through the polarity receptacle opening 32*a*, 32*b* on the registration assembly 39. Movement of the shutter members 28, 43 also causes the compression of resilient members 10*a* and 10*b*. The shutter blocking members 25 and 55 also move to open access to polarity receptacle openings 32*a* and 32*b* as can be seen in FIG. 9. Each plug element 70*a* and 70*b* can pass through the respective polarity opening 32*a*, 32*b* and enable an electrical connection with one of, for example, a hot or neutral power receptacle of connector. It is noted that when the plug blades 70*a*, 70*b* are pulled out, the shutters 28, 43 return to the initial, closed position, from for example forces exerted on the respective shutter members 28, 43 by the resilient members 10*a*, 10*b*. By returning the shutter members 28, 43 to the initial position, the neutral receptacle opening 64, 264 and the hot receptacle opening 6, 264 are blocked again.

The aspects of the disclosed embodiments provide an electrical receptacle with a protective shutter where the shutter sub-assembly inside one receptacle opening will open only when the other receptacle opening is inserted, substantially simultaneously, with a plug blade having a predetermined plug blade geometry, and then with the push of the spring, the shutter sub-assembly will finally turn to open position. This approach effectively prevents the hidden danger of foreign objects insertion into one of the receptacle contact opening which will cause electric shock hazard.

It should be understood that the foregoing description is only illustrative of the embodiments. Various alternatives and modifications can be devised by those skilled in the art without departing from the embodiments. Accordingly, the present embodiments are intended to embrace all such alternatives, modifications and variances that fall within the scope of the appended claims.

What is claimed is:

1. A protective shutter assembly comprising:

a registration member having longitudinal and lateral axes;

first and second shutter members slidably mounted in the registration member, each shutter member including a ramp member and a receptacle blocking member, the ramp member being configured to lie in a path of a first receptacle opening and the receptacle blocking member being configured to lie in a path o a second receptacle opening;

spring members connected between the registration member and respective ones of the first and second shutter members, the spring members being configured to bias the first and second shutter members so that the ramp members lie in a path of a respective receptacle opening;

wherein the first and second shutter members are independently movable such that when an object exerts a force on only one ramp member, a respective shutter member moves relative to the other shutter member such that the one ramp member is longitudinally displaced allowing the object to contact the receptacle blocking member of the other shutter member; and wherein when an object exerts force simultaneously on each of the pair of shutter members, the pair of shutter members are configured to move longitudinally in the same direction for unblocking the receptacle openings.

2. The protective shutter assembly of claim 1, wherein when the respective shutter member is displaced, a spring member biasing the respective shutter member is compressed while a spring member biasing the other shutter member remains substantially stationary.

3. The protective shutter assembly of claim 1, wherein one of the first and second receptacle openings is a generally T-shaped receptacle opening, the protective shutter assembly further comprising a third shutter member configured to block a portion of the T-shaped receptacle opening.

4. The protective shutter assembly of claim 3, wherein the third shutter member is configured to move laterally for unblocking the portion of the T-shaped receptacle opening.

5. The protective shutter assembly of claim 3, wherein the first shutter member includes a retainer member configured to hold the third shutter member in a position for blocking the portion of the T-shaped receptacle opening.

6. The protective shutter assembly of claim 5, wherein the third shutter member comprises a chamfer for accepting the retainer member such that when the first shutter member is displaced the retainer aligns with the chamfer allowing lateral movement of the third shutter member for unblocking the portion of the T-shaped receptacle opening.

7. The protective shutter assembly of claim 3, wherein the second shutter member includes a retainer member configured to hold the third shutter member in a position for blocking the portion of the T-shaped receptacle opening.

8. The protective shutter assembly of claim 7, wherein the third shutter member comprises a recess for accepting the retainer member such that when the second shutter member is displaced the retainer disengages the recess allowing lateral movement of the third shutter member for unblocking the portion of the T-shaped opening.

9. An apparatus comprising:

a cover assembly having a longitudinal and lateral axes, the cover assembly including at least one registration member and receptacle openings;

a protective shutter assembly set in the cover assembly, the at least one registration member being configured to guide movement of shutter members of the protective shutter assembly along one of the longitudinal and lateral axes;

spring members disposed within the protective shutter assembly, the spring members being configured to bias at least one shutter member in a closed position for blocking a respective receptacle opening;

wherein the shutter members are independently movable such that when an object exerts a force on only one ramp member of a longitudinally moveable shutter member, a respective longitudinally movable shutter member moves relative to the other longitudinally movable shutter member such that the one ramp member is displaced allowing the object to contact the receptacle blocking member of the other longitudinally movable shutter member; and wherein when an object exerts force simultaneously on each of the longitudinally movable shutter members, the longitudinally movable shutter members are configured to move in the same direction for unblocking the receptacle openings.

10. The apparatus of claim 9, wherein when the respective longitudinally movable shutter member is displaced, a spring member biasing the respective shutter member is compressed while a spring member biasing the other longitudinally movable shutter member remains substantially stationary.

11. The apparatus of claim 9, wherein one of the receptacle openings is a generally T-shaped receptacle opening, the protective shutter assembly further comprising laterally movable shutter member configured to block a portion of the T-shaped receptacle opening.

12. The apparatus of claim 11, wherein a first longitudinally movable shutter member includes a retainer member configured to hold the laterally moveable shutter member in a position for blocking the portion of the T-shaped receptacle opening.

13. The apparatus of claim 12, wherein the laterally moveable shutter member comprises a chamfer for accepting the retainer member such that when the first longitudinally movable shutter member is displaced the retainer aligns with the chamfer allowing lateral movement of the third shutter member for unblocking the portion of the T-shaped receptacle opening.

14. A method for selectively blocking and providing access to receptacle openings of an electrical outlet having a longitudinal and lateral axes, the method comprising:

biasing first and second longitudinally movable shutter members for blocking respective receptacle openings of the electrical outlet;

allowing relative movement between the first and second shutter members so that as an object applies force to only one of the first or second shutter member, the force displaces the first or second shutter member to expose a blocking member of the other one of the first or second shutter member for preventing entry of the object in the respective receptacle;

wherein when force is substantially simultaneously applied to the first and second shutter members, allowing substantially simultaneous longitudinal movement of the first and second shutter members in the same direction for unblocking the respective receptacle openings; and wherein one of the receptacle openings comprises a T-shaped receptacle opening, the method further comprising holding a laterally movable shutter member with a retainer of first shutter member for blocking a portion of the T-shaped receptacle opening.

15. The method of claim 14, further comprising longitudinally moving the first shutter member for aligning the retainer with a chamfer of the laterally movable shutter member for allowing lateral movement of the laterally moveable shutter member for unblocking the portion of the T-shaped receptacle opening.

16. The method of claim 14, wherein the receptacle openings are unblocked when force is applied substantially simultaneously to at least the first shutter member and the laterally moveable shutter member.

* * * * *